US010163400B2

(12) United States Patent
Chen et al.

(10) Patent No.: US 10,163,400 B2
(45) Date of Patent: Dec. 25, 2018

(54) DISPLAY DRIVING APPARATUS

(71) Applicant: Raydium Semiconductor Corporation, Hsinchu (TW)

(72) Inventors: Huang-Ren Chen, New Taipei (TW); Cheng-Nan Lin, Taipei (TW); Shao-Ping Hung, Hsinchu (TW)

(73) Assignee: Raydium Semiconductor Corporation, Hsinchu County (TW)

( * ) Notice: Subject to any disclaimer, the term of this patent is extended or adjusted under 35 U.S.C. 154(b) by 0 days.

(21) Appl. No.: 15/603,657

(22) Filed: May 24, 2017

(65) Prior Publication Data

US 2017/0345374 A1 Nov. 30, 2017

Related U.S. Application Data

(60) Provisional application No. 62/343,154, filed on May 31, 2016.

(51) Int. Cl.
*G09G 3/3258* (2016.01)
*G09G 3/3275* (2016.01)

(52) U.S. Cl.
CPC ..... *G09G 3/3258* (2013.01); *G09G 3/3275* (2013.01); *G09G 2310/0251* (2013.01); *G09G 2310/0289* (2013.01); *G09G 2320/0646* (2013.01); *G09G 2320/0673* (2013.01); *G09G 2330/023* (2013.01)

(58) Field of Classification Search
None
See application file for complete search history.

(56) References Cited

U.S. PATENT DOCUMENTS

2013/0249955 A1* 9/2013 Kim ..... G09G 3/3233 345/690
2016/0019839 A1* 1/2016 In ..... G09G 3/3258 345/212

* cited by examiner

*Primary Examiner* — Abbas I Abdulselam

(57) ABSTRACT

A display driving apparatus including a lightness adjusting unit, a gamma adjusting unit, a pre-charging voltage adjusting unit and a source driving unit is disclosed. The lightness adjusting unit receives and adjusts a lightness of an image data. The gamma adjusting unit adjusts a gamma voltage corresponding to the image data to generate a source data voltage. The pre-charging voltage adjusting unit calculates a highest data voltage and a lowest data voltage which can be outputted by a source electrode and adjusts a pre-charging voltage accordingly to make the adjusted pre-charging voltage the same with the highest data voltage or the lowest data voltage or only a shifted voltage different from the highest data voltage or the lowest data voltage of the image data. The source driving unit outputs the adjusted pre-charging voltage and the source data voltage to a display panel respectively.

12 Claims, 5 Drawing Sheets

DISPLAY DRIVING APPARATUS

BACKGROUND OF THE INVENTION

1. Field of the Invention

This invention relates to a display, especially to a display driving apparatus.

2. Description of the Prior Art

With the progress of technology, various kinds of portable electronic apparatus, such as smart phone or tablet computer, have been widely used in our daily life. Because the portable electronic apparatus provides more and more functions, how to save its power consumption to extend its usage time has become a very important issue.

In general, the display driving chip capable of saving more power can provide more usage time for the user. As to the OLED display panel, in order to improve the situation that different transistors have different threshold voltages respectively due to the manufacturing process variations, the conventional compensating method is to pre-charge a fixed voltage to the different transistors and then compensate the different threshold voltages of the transistors through the operation of the inner compensating capacitor.

However, because this fixed pre-charging voltage Vpre should be larger than or equal to the maximum source data voltage Vmax (as shown in FIG. 1) or this fixed pre-charging voltage Vpre should be smaller than or equal to the minimum source data voltage Vmin (as shown in FIG. 2), and this fixed pre-charging voltage Vpre will not be varied with the adjustments of the displayed contents and lightness. Once the voltage difference between this fixed pre-charging voltage Vpre and the maximum source data voltage/the minimum source data voltage becomes larger, the redundant power consumption will also become larger and fail to achieve power saving effect.

SUMMARY OF THE INVENTION

Therefore, the invention provides a display driving apparatus to solve the above-mentioned problems in the prior arts.

An embodiment of the invention is a display driving apparatus. In this embodiment, the display driving apparatus includes a lightness adjusting unit, a gamma adjusting unit, a pre-charging voltage adjusting unit and a source driving unit. The lightness adjusting unit receives and adjusts a lightness of an image data. The gamma adjusting unit adjusts a gamma voltage corresponding to the image data to generate a source data voltage. The pre-charging voltage adjusting unit calculates a highest data voltage and a lowest data voltage which can be outputted by a source electrode and adjusts a pre-charging voltage accordingly to make the adjusted pre-charging voltage the same with the highest data voltage or the lowest data voltage or only a shifted voltage different from the highest data voltage or the lowest data voltage of the image data. The source driving unit outputs the adjusted pre-charging voltage and the source data voltage to a display panel respectively.

In an embodiment, the display panel is an OLED display panel.

In an embodiment, since the adjusted pre-charging voltage is the same with the highest data voltage or the lowest data voltage or the adjusted pre-charging voltage is only the shifted voltage different from the highest data voltage or the lowest data voltage of the image data, a voltage difference between the adjusted pre-charging voltage and the source data voltage is smaller than or equal to the shifted voltage to reduce redundant power consumption.

In an embodiment, the adjusted pre-charging voltage is the same with the highest data voltage or the adjusted pre-charging voltage is higher than the highest data voltage.

In an embodiment, the adjusted pre-charging voltage is the same with the highest data voltage or the adjusted pre-charging voltage is lower than the highest data voltage.

Another embodiment of the invention is a display driving apparatus. In this embodiment, the display driving apparatus is coupled to a display panel. The display driving apparatus includes a lightness adjusting unit, a gamma adjusting unit, a pre-charging voltage adjusting unit and a source driving unit. The lightness adjusting unit is used for receiving an image data and adjusting a lightness of a row image data of the image data. The gamma adjusting unit is coupled to the lightness adjusting unit and used for adjusting a gamma voltage corresponding to the row image data to generate a source data voltage corresponding to the row image data. The pre-charging voltage adjusting unit is coupled to the gamma adjusting unit and used for calculating a highest data voltage and a lowest data voltage corresponding to the row image data which can be outputted by a source electrode and adjusting a pre-charging voltage accordingly to make the adjusted pre-charging voltage corresponding to the row image data the same with the highest data voltage or the lowest data voltage corresponding to the row image data or the adjusted pre-charging voltage corresponding to the row image data only a shifted voltage different from the highest data voltage or the lowest data voltage corresponding to the row image data. The source driving unit is coupled among the gamma adjusting unit, the pre-charging voltage adjusting unit and the display panel and used for outputting the adjusted pre-charging voltage corresponding to the row image data and the source data voltage corresponding to the row image data to the display panel respectively.

Compared to the prior art, the display driving apparatus of the invention dynamically adjusts the pre-charging voltage correspondingly according to the current display content or lightness adjustment instead of using the fixed pre-charging voltage, so that the difference between the adjusted pre-charging voltage and the maximum source data voltage/the minimum source data voltage will become smaller to reduce the redundant power consumption and achieve power saving effect.

The advantage and spirit of the invention may be understood by the following detailed descriptions together with the appended drawings.

BRIEF DESCRIPTION OF THE APPENDED DRAWINGS

DETAILED DESCRIPTION OF THE INVENTION

A preferred embodiment of the invention is a display driving apparatus. In this embodiment, the display driving apparatus can be a driving IC in a display apparatus, but not limited to this.

Figure 1:
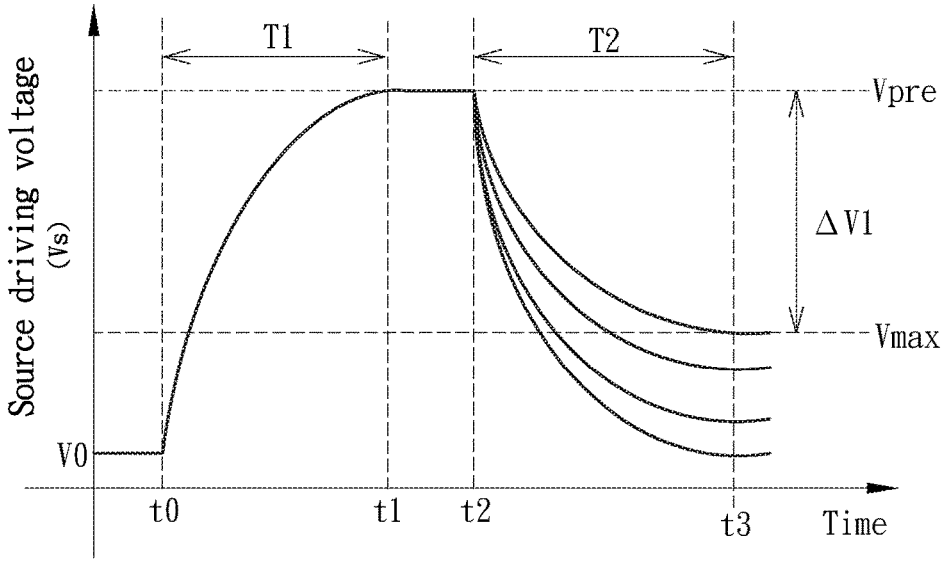
FIG. 1 (PRIOR ART)
FIG. 1 and FIG. 2 illustrate schematic diagrams of more redundant power consumption caused by the fixed pre-charging voltage used in the prior art.
Figure 2:
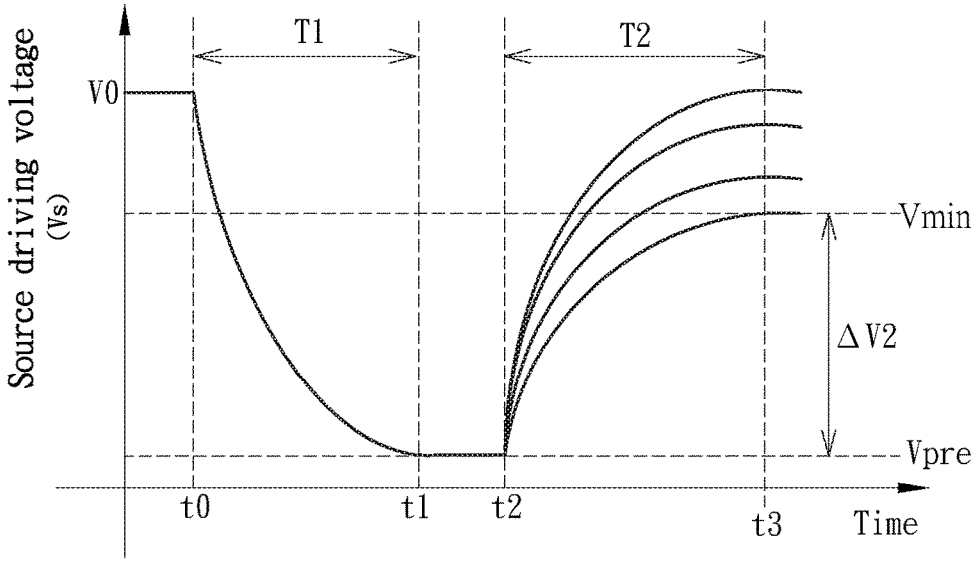
FIG. 2 (PRIOR ART)
Figure 3:
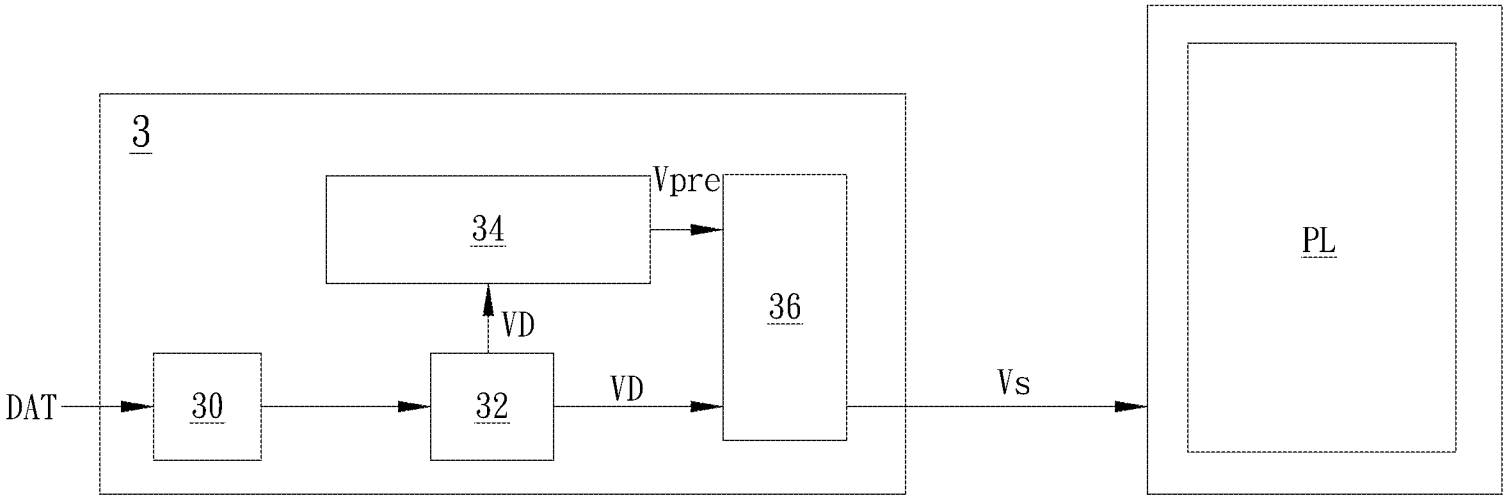
FIG. 3 illustrates a functional block diagram of the display driving apparatus in a preferred embodiment of the invention.

Please refer to FIG. 3. FIG. 3 illustrates a functional block diagram of the display driving apparatus in this embodiment. As shown in FIG. 3, the display driving apparatus 3 is coupled to a display panel PL. In practical applications, the display panel PL can be an OLED display panel, but not limited to this.

The display driving apparatus 3 includes a lightness adjusting unit 30, a gamma adjusting unit 32, a pre-charging voltage adjusting unit 34 and a source driving unit 36. Wherein, the lightness adjusting unit 30 is coupled to the gamma adjusting unit 32; the gamma adjusting unit 32 is coupled to the pre-charging voltage adjusting unit 34 and the source driving unit 36 respectively; the pre-charging voltage adjusting unit 34 is coupled to the source driving unit 36; the source driving unit 36 is coupled to the display panel PL.

Then, functions of the units in the display driving apparatus 3 will be introduced in detail as follows.

As shown in FIG. 3, when an image data DAT is transmitted to the display driving apparatus 3, the lightness adjusting unit 30 will receive the image data DAT and adjust a lightness of the image data DAT.

It should be noticed that the lightness adjusting unit 30 can adjust the lightness of the image data DAT by increasing the lightness of the image data DAT or decreasing the lightness of the image data DAT based on the requirements of the user or system without any specific limitations.

Then, after the lightness adjusting unit 30 finishes the lightness adjustment of the image data DAT, the lightness adjusting unit 30 will transmit the adjusted image data DAT to the gamma adjusting unit 32, and the gamma adjusting unit 32 will adjust a gamma voltage corresponding to the image data DAT to generate a source data voltage $V_D$.

The pre-charging voltage adjusting unit 34 is used to calculate a highest data voltage and a lowest data voltage which can be outputted by a source electrode and adjust a pre-charging voltage Vpre accordingly, so that the adjusted pre-charging voltage Vpre can be the same with the highest data voltage or the lowest data voltage or can be only a shifted voltage Voffset different from the highest data voltage or the lowest data voltage of the image data DAT.

After the pre-charging voltage adjusting unit 34 finishes the adjustment of the pre-charging voltage Vpre, the source driving unit 36 will receive the source data voltage $V_D$ from the gamma adjusting unit 32 and the adjusted pre-charging voltage Vpre from the pre-charging voltage adjusting unit 34 respectively and then output the adjusted pre-charging voltage Vpre and the source data voltage $V_D$ to the display panel PL respectively.

It should be noticed that since the pre-charging voltage Vpre adjusted by the pre-charging voltage adjusting unit 34 can be the same with the highest data voltage Vmax or the lowest data voltage Vmin or can be only a shifted voltage Voffset different from the highest data voltage Vmax or the lowest data voltage Vmin of the image data DAT, the voltage difference between the adjusted pre-charging voltage Vpre and the source data voltage $V_D$ will be smaller than or equal to the shifted voltage Voffset, so that redundant power consumption can be reduced.

Figure 4A:
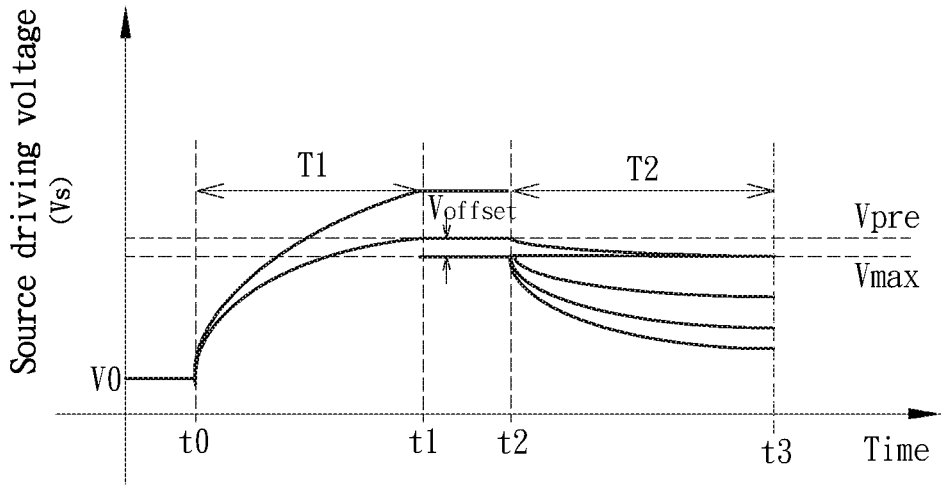
FIG. 4A and FIG. 4B illustrate schematic diagrams of the display driving apparatus of FIG. 3 using dynamically adjusted pre-charging voltage to effectively reduce redundant power consumption.

In an embodiment, as shown in FIG. 4A, T1 represents the pre-charging time between the times t0 and t1; T2 represents the data charging time between the times t2 and t3. During the pre-charging time T1, the upper curve is the original pre-charging voltage curve and the lower curve is the adjusted pre-charging voltage curve. At the time t0, the source driving voltage Vs equals to the original voltage value V0; after the voltage pre-charging is finished, at the time t1, the source driving voltage Vs becomes the adjusted pre-charging voltage Vpre. And, the adjusted pre-charging voltage Vpre is only the shifted voltage Voffset higher than the highest data voltage Vmax; that is to say, the voltage difference between the adjusted pre-charging voltage Vpre and the highest data voltage Vmax in the invention is obviously smaller than the voltage difference between the original voltage value V0 and the highest data voltage Vmax in the prior art. Therefore, the redundant power consumption can be effectively reduced.

Figure 4B:
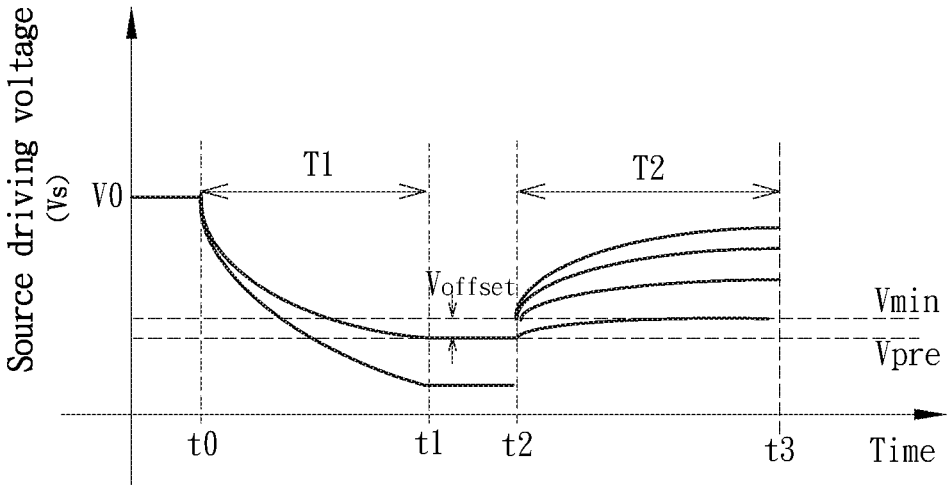

In another embodiment, as shown in FIG. 4B, T1 represents the pre-charging time between the times t0 and t1; T2 represents the data charging time between the times t2 and t3. During the pre-charging time T1, the lower curve is the original pre-charging voltage curve and the upper curve is the adjusted pre-charging voltage curve. At the time t0, the source driving voltage Vs equals to the original voltage value V0; after the voltage pre-charging is finished, at the time t1, the source driving voltage Vs becomes the adjusted pre-charging voltage Vpre. And, the adjusted pre-charging voltage Vpre is only the shifted voltage Voffset lower than the lowest data voltage Vmin; that is to say, the voltage difference between the adjusted pre-charging voltage Vpre and the lowest data voltage Vmin in the invention is obviously smaller than the voltage difference between the original voltage value V0 and the lowest data voltage Vmin in the prior art. Therefore, the redundant power consumption can be effectively reduced.

Another preferred embodiment of the invention is also a display driving apparatus. In this embodiment, the display driving apparatus can be a driving IC in a display apparatus, but not limited to this.

Figure 5:
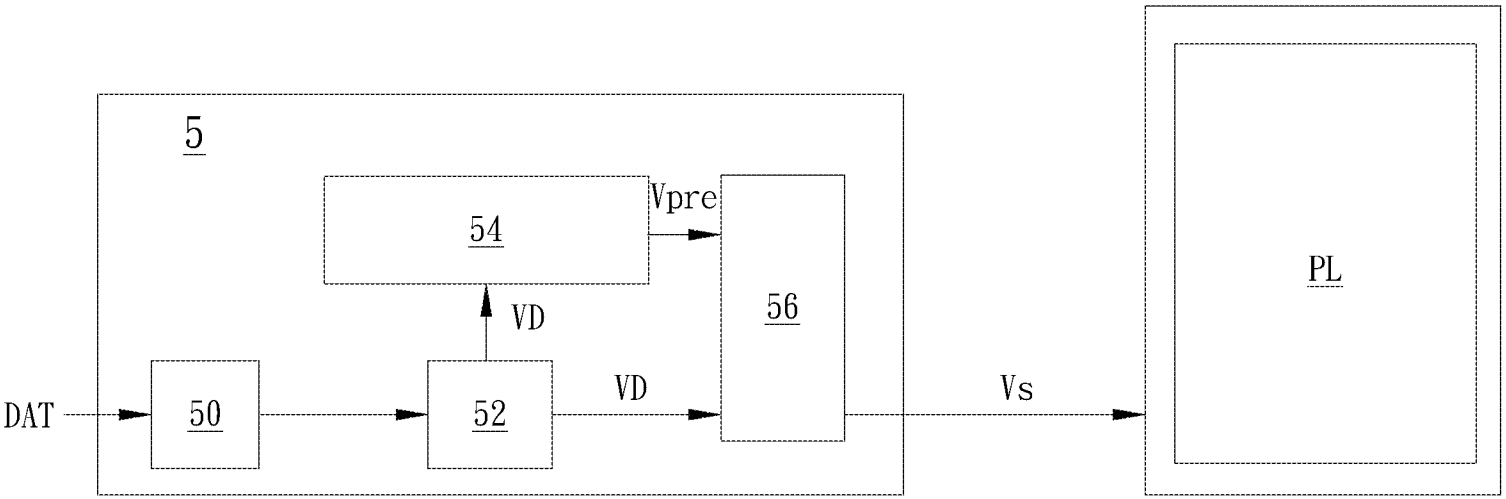
FIG. 5 illustrates a functional block diagram of the display driving apparatus in another preferred embodiment of the invention.

Please refer to FIG. 5. FIG. 5 illustrates a functional block diagram of the display driving apparatus in this embodiment. As shown in FIG. 5, the display driving apparatus 5 is coupled to a display panel PL. In practical applications, the display panel PL can be an OLED display panel, but not limited to this.

The display driving apparatus 5 includes a lightness adjusting unit 50, a gamma adjusting unit 52, a pre-charging voltage adjusting unit 54 and a source driving unit 56. Wherein, the lightness adjusting unit 50 is coupled to the gamma adjusting unit 52; the gamma adjusting unit 52 is coupled to the pre-charging voltage adjusting unit 54 and the source driving unit 56 respectively; the pre-charging voltage adjusting unit 54 is coupled to the source driving unit 56; the source driving unit 56 is coupled to the display panel PL.

Then, functions of the units in the display driving apparatus 5 will be introduced in detail as follows.

As shown in FIG. 5, when an image data DAT is transmitted to the display driving apparatus 5, the lightness adjusting unit 50 will receive the image data DAT and adjust a lightness of a low image data in the image data DAT.

It should be noticed that the lightness adjusting unit 50 can adjust the lightness of the row image data of the image data DAT by increasing the lightness of the row image data or decreasing the lightness of the row image data based on the requirements of the user or system without any specific limitations.

Then, after the lightness adjusting unit 50 finishes the lightness adjustment of the row image data of the image data DAT, the lightness adjusting unit 50 will transmit the adjusted row image data of the image data DAT to the gamma adjusting unit 52, and the gamma adjusting unit 52 will adjust a gamma voltage corresponding to the row image data of the image data DAT to generate a source data voltage $V_D$.

The pre-charging voltage adjusting unit 54 is used to calculate a highest data voltage Vmax and a lowest data voltage Vmin corresponding to the row image data which can be outputted by a source electrode and adjust a pre-charging voltage Vpre corresponding to the row image data accordingly, so that the adjusted pre-charging voltage Vpre corresponding to the row image data can be the same with the highest data voltage Vmax or the lowest data voltage Vmin corresponding to the row image data or the adjusted pre-charging voltage Vpre corresponding to the row image data can be only a shifted voltage Voffset different from the highest data voltage Vmax or the lowest data voltage Vmin corresponding to the row image data.

After the pre-charging voltage adjusting unit 54 finishes the adjustment of the pre-charging voltage Vpre corresponding to the row image data, the source driving unit 56 will receive the source data voltage $V_D$ corresponding to the row image data from the gamma adjusting unit 52 and the adjusted pre-charging voltage Vpre corresponding to the row image data from the pre-charging voltage adjusting unit 54 respectively and then output the adjusted pre-charging voltage Vpre corresponding to the row image data and the source data voltage $V_D$ corresponding to the row image data to the display panel PL respectively.

It should be noticed that since the pre-charging voltage Vpre corresponding to the row image data adjusted by the pre-charging voltage adjusting unit 54 can be the same with the highest data voltage Vmax or the lowest data voltage Vmin corresponding to the row image data or the pre-charging voltage Vpre corresponding to the row image data can be only the shifted voltage Voffset different from the highest data voltage Vmax or the lowest data voltage Vmin corresponding to the row image data, the voltage difference between the adjusted pre-charging voltage Vpre and the source data voltage $V_D$ corresponding to the row image data will be smaller than or equal to the shifted voltage Voffset, so that redundant power consumption can be reduced.

Figure 6A:
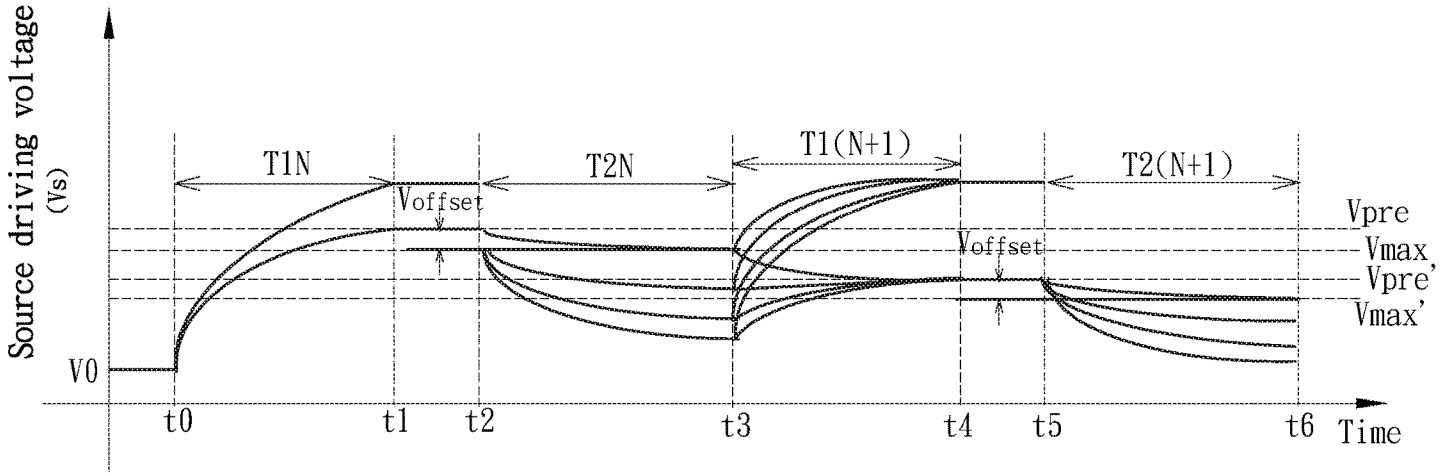
FIG. 6A and FIG. 6B illustrate schematic diagrams of the display driving apparatus of FIG. 5 using dynamically adjusted pre-charging voltage to effectively reduce redundant power consumption.

In an embodiment, as shown in FIG. 6A, T1N represents the pre-charging time of the N-th row image data between the times t0 and t1; T2N represents the data charging time of the N-th row image data between the times t2 and t3. During the pre-charging time T1N of the N-th row image data, the upper curve is the original pre-charging voltage curve and the lower curve is the adjusted pre-charging voltage curve. At the time t0, the source driving voltage Vs equals to the original voltage value V0; after the voltage pre-charging is finished, at the time t1, the source driving voltage Vs becomes the adjusted pre-charging voltage Vpre. And, the adjusted pre-charging voltage Vpre is only the shifted voltage Voffset higher than the highest data voltage Vmax corresponding the N-th row image data; that is to say, the voltage difference between the adjusted pre-charging voltage Vpre and the highest data voltage Vmax corresponding the N-th row image data in the invention is obviously smaller than the voltage difference between the original voltage value V0 and the highest data voltage Vmax corresponding the N-th row image data in the prior art. Therefore, the redundant power consumption can be effectively reduced.

Then, T1(N+1) represents the pre-charging time of the (N+1)-th row image data between the times t3 and t4; T2(N+1) represents the data charging time of the (N+1)-th row image data between the times t5 and t6. During the pre-charging time T1(N+1) of the (N+1)-th row image data, the upper curve is the original pre-charging voltage curve and the lower curve is the adjusted pre-charging voltage curve. After the voltage pre-charging is finished, at the time t4, the source driving voltage Vs becomes the adjusted pre-charging voltage Vpre'. And, the adjusted pre-charging voltage Vpre' is only the shifted voltage Voffset higher than the highest data voltage Vmax' corresponding the (N+1)-th row image data; that is to say, the voltage difference between the adjusted pre-charging voltage Vpre' and the highest data voltage Vmax' corresponding the (N+1)-th row image data in the invention is obviously smaller than the voltage difference in the prior art. Therefore, the redundant power consumption can be effectively reduced.

Figure 6B:
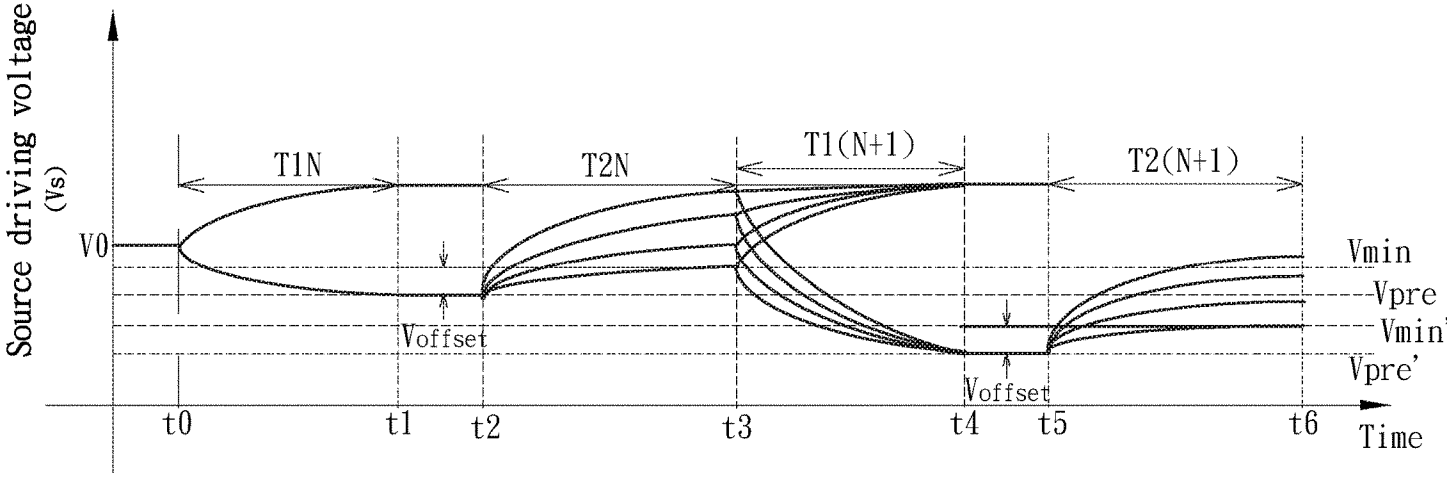

In another embodiment, as shown in FIG. 6B, T1N represents the pre-charging time of the N-th row image data between the times t0 and t1; T2N represents the data charging time of the N-th row image data between the times t2 and t3. During the pre-charging time T1N, the lower curve is the original pre-charging voltage curve and the upper curve is the adjusted pre-charging voltage curve. At the time t0, the source driving voltage Vs equals to the original voltage value V0; after the voltage pre-charging is finished, at the time t1, the source driving voltage Vs becomes the adjusted pre-charging voltage Vpre. And, the adjusted pre-charging voltage Vpre is only the shifted voltage Voffset lower than the lowest data voltage Vmin; that is to say, the voltage difference between the adjusted pre-charging voltage Vpre and the lowest data voltage Vmin corresponding to the N-th row image data in the invention is obviously smaller than the voltage difference between the original voltage value V0 and the lowest data voltage Vmin corresponding to the N-th row image data in the prior art. Therefore, the redundant power consumption can be effectively reduced.

Then, T1(N+1) represents the pre-charging time of the (N+1)-th row image data between the times t3 and t4; T2(N+1) represents the data charging time of the (N+1)-th row image data between the times t5 and t6. During the pre-charging time T1(N+1) of the (N+1)-th row image data, the upper curve is the original pre-charging voltage curve and the lower curve is the adjusted pre-charging voltage curve. After the voltage pre-charging is finished, at the time t4, the source driving voltage Vs becomes the adjusted pre-charging voltage Vpre'. And, the adjusted pre-charging voltage Vpre' is only the shifted voltage Voffset lower than the lowest data voltage Vmin' corresponding the (N+1)-th row image data; that is to say, the voltage difference between the adjusted pre-charging voltage Vpre' and the lowest data voltage Vmin' corresponding the (N+1)-th row image data in the invention is obviously smaller than the voltage difference in the prior art. Therefore, the redundant power consumption can be effectively reduced.

Compared to the prior art, the display driving apparatus of the invention dynamically adjusts the pre-charging voltage correspondingly according to the current display content or lightness adjustment instead of using the fixed pre-charging voltage, so that the difference between the adjusted pre-charging voltage and the maximum source data voltage/the minimum source data voltage will become smaller to reduce the redundant power consumption and achieve power saving effect.

With the example and explanations above, the features and spirits of the invention will be hopefully well described. Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A display driving apparatus, coupled to a display panel, the display driving apparatus comprising:

a lightness adjusting unit, configured to receive an image data and adjust a lightness of the image data;

a gamma adjusting unit, coupled to the lightness adjusting unit, for adjusting a gamma voltage corresponding to the image data to generate a source data voltage;

a pre-charging voltage adjusting unit, coupled to the gamma adjusting unit, for calculating a highest data voltage and a lowest data voltage which can be outputted by a source electrode and adjusting a pre-charging voltage accordingly to make the adjusted pre-charging voltage the same with the highest data voltage or the lowest data voltage or the adjusted pre-charging voltage only a shifted voltage different from the highest data voltage or the lowest data voltage of the image data; and a source driving unit, coupled among the gamma adjusting unit, the pre-charging voltage adjusting unit and the display panel, for outputting the adjusted pre-charging voltage and the source data voltage to the display panel respectively.

2. The display driving apparatus of claim 1, wherein the display panel is an OLED display panel.

3. The display driving apparatus of claim 1, wherein since the adjusted pre-charging voltage is the same with the highest data voltage or the lowest data voltage or the adjusted pre-charging voltage is only the shifted voltage different from the highest data voltage or the lowest data voltage of the image data, a voltage difference between the adjusted pre-charging voltage and the source data voltage is smaller than or equal to the shifted voltage to reduce redundant power consumption.

4. The display driving apparatus of claim 1, wherein the adjusted pre-charging voltage is the same with the highest data voltage or the adjusted pre-charging voltage is higher than the highest data voltage.

5. The display driving apparatus of claim 1, wherein the adjusted pre-charging voltage is the same with the highest data voltage or the adjusted pre-charging voltage is lower than the highest data voltage.

6. A display driving apparatus, coupled to a display panel, the display driving apparatus comprising:

a lightness adjusting unit, configured to receive an image data and adjust a lightness of a row image data of the image data;

a gamma adjusting unit, coupled to the lightness adjusting unit, for adjusting a gamma voltage corresponding to the row image data to generate a source data voltage corresponding to the row image data;

a pre-charging voltage adjusting unit, coupled to the gamma adjusting unit, for calculating a highest data voltage and a lowest data voltage corresponding to the row image data which can be outputted by a source electrode and adjusting a pre-charging voltage accordingly to make the adjusted pre-charging voltage corresponding to the row image data the same with the highest data voltage or the lowest data voltage corresponding to the row image data or the adjusted pre-charging voltage corresponding to the row image data only a shifted voltage different from the highest data voltage or the lowest data voltage corresponding to the row image data; and a source driving unit, coupled among the gamma adjusting unit, the pre-charging voltage adjusting unit and the display panel, for outputting the adjusted pre-charging voltage corresponding to the row image data and the source data voltage corresponding to the row image data to the display panel respectively.

7. The display driving apparatus of claim 6, wherein the display panel is an OLED display panel.

8. The display driving apparatus of claim 6, wherein since the adjusted pre-charging voltage corresponding to the row image data is the same with the highest data voltage or the lowest data voltage corresponding to the row image data or the adjusted pre-charging voltage corresponding to the row image data is only the shifted voltage different from the highest data voltage or the lowest data voltage of the image data corresponding to the row image data, a voltage difference between the adjusted pre-charging voltage corresponding to the row image data and the source data voltage corresponding to the row image data is smaller than or equal to the shifted voltage to reduce redundant power consumption.

9. The display driving apparatus of claim 6, wherein the adjusted pre-charging voltage corresponding to the row image data is the same with the highest data voltage corresponding to the row image data or the adjusted pre-charging voltage corresponding to the row image data is higher than the highest data voltage corresponding to the row image data.

10. The display driving apparatus of claim 6, wherein the adjusted pre-charging voltage corresponding to the row image data is the same with the highest data voltage corresponding to the row image data or the adjusted pre-charging voltage corresponding to the row image data is lower than the highest data voltage corresponding to the row image data.

11. The display driving apparatus of claim 6, wherein the lightness adjusting unit further adjusts a lightness of another row image data of the image data and the gamma adjusting unit adjusts a gamma voltage corresponding to the another row image data to generate another source data voltage corresponding to the another row image data.

12. The display driving apparatus of claim 11, wherein the pre-charging voltage adjusting unit calculates another highest data voltage and another lowest data voltage corresponding to the another row image data which can be outputted by the source electrode and adjusts another pre-charging voltage corresponding to the another row image data accordingly to make the adjusted another pre-charging voltage corresponding to the another row image data the same with the another highest data voltage or the another lowest data voltage corresponding to the another row image data or the adjusted another pre-charging voltage corresponding to the another row image data only the shifted voltage different from the another highest data voltage or the another lowest data voltage corresponding to the another row image data, and the source driving unit outputs the adjusted another pre-charging voltage corresponding to the another row image data and the another source data voltage corresponding to the another row image data to the display panel respectively.

* * * * *